United States Patent [19]

Ruffo et al.

[11] 4,018,646

[45] Apr. 19, 1977

[54] NONWOVEN FABRIC

[75] Inventors: Angelo P. Ruffo, Montreal; Prashant K. Goyal, Roxboro, both of Canada

[73] Assignee: Johnson & Johnson, New Brunswick, N.J.

[22] Filed: Oct. 29, 1975

[21] Appl. No.: 626,883

Related U.S. Application Data

[60] Continuation of Ser. No. 358,783, May 9, 1973, abandoned, which is a division of Ser. No. 108,546, Jan. 21, 1971, Pat. No. 3,768,118.

[52] U.S. Cl. ..... 162/146; 162/149; 428/298; 428/303

[51] Int. Cl.[2] ..... D21H 5/26

[58] Field of Search ..... 162/129, 188, 146, 149, 162/136, 123; 264/122; 428/303, 298

[56] References Cited

UNITED STATES PATENTS

| | | | |
|---|---|---|---|
| 3,057,772 | 10/1962 | Magill et al. | 162/146 |
| 3,158,532 | 11/1964 | Pall et al. | 162/146 |
| 3,535,187 | 10/1970 | Wood | 156/370 |
| 3,755,028 | 8/1973 | Wood | 156/62.2 |

FOREIGN PATENTS OR APPLICATIONS

| | | |
|---|---|---|
| 827,643 | 2/1960 | United Kingdom |

*Primary Examiner*—S. Leon Bashore
*Assistant Examiner*—William F. Smith

[57] ABSTRACT

A novel web that can be produced by the process of the present invention is comprised of two different types of fibers, with the web characterized by having a predominance of one fiber type at one of its major faces, and a predominance of the other fiber type at the other of its major faces. The web includes a transition between the faces in which the predominance of the fibers decreases uniformly away from the face at which they predominate.

4 Claims, 11 Drawing Figures

PULP AIR
FIBER AIR
PULP
STAPLE FIBERS
W
F 400
1.
406
402
404
320
319
330
312
341
338
370
372
380
369
368
W
381
389
348
350

369
381
380
4.
350
348
389

380
379
378
376
369
349
381

NONWOVEN FABRIC

This application is a continuation of application Ser. No. 358,783 filed May 9, 1973, now abandoned which in turn is a divisional of application Ser. No. 108,546, filed Jan. 21, 1971, which is now U.S. Pat. No. 3,768,118 issued Oct. 30, 1973.

This invention relates to a process and product. More particularly, this invention relates to an improved process for air-laying fibers to produce air-laid nonwoven webs, preferably having randomly oriented fibers more or less uniformly throughout the web, so that the web has substantially uniform characteristics lengthwise and crosswise thereof; and in another aspect, the invention relates to a random nonwoven web having unique properties. Preferably, the web comprises a blend of long and short fibers; i.e., textile length and papermaking fibers.

Fibers are usually classified according to length, with relatively long or textile length fibers being longer than about one-fourth inch and generally between one-half and two one-half inches in length. The term "long fibers" as used herein, refers to textile fibers having a length greater than one-fourth inch, and the fibers may be of natural or synthetic origin. The term "short fibers," as used herein, refers to papermaking fibers, such as wood pulp fibers or cotton linters having a length less than about one-fourth inch. While it is recognized that short fibers are usually substantially less costly than long fibers, it is also recognized in many instances that it is desirable to strengthen a short fiber product by includng a blend of long fibers therein.

Nonwoven materials are structures which in general consist of an assemblage or web of fibers, joined randomly or systematically by mechanical, chemical or other means. These materials are well known in the art, having gained considerable prominence within the last 20 years or so in the consumer market, the industrial commercial market and the hospital field. For exmple, nonwoven materials are becoming increasingly important in the textile and related fields, one reason being because of their low cost of manufacture for a given coverage as compared to the cost of more conventional textile fabrics made by weaving, knitting or felting. Typical of their use is hospital caps, dental bibs, eye pads, dress shields, shoe liners, shoulder pads, skirts, hand towels, handkerchiefs, tapes, bags, table napkins, curtains, draperies, etc. Generally speaking, nonwoven materials are available today in a wide range of fabric weights of from as little as about 100 grains per square yard to as much as about 4,000 grains or more square yard.

Nonwoven materials are basically one of two types — oriented webs or random webs. As the name implies, oriented webs have the major proportion of the fibers aligned predominantly in one direction, generally the "machine" or long direction (MD) of the fibrous web so that the properties of the resulting web are asymmetrical or anisotropic — i.e. conventionally the tensile strengths in the machine direction are generally approximately eight or more times higher than in the cross direction (CD); while on the other hand, random fibrous nonwoven webs do not have the fibers lying predominantly in any direction so that the resulting web is more balanced or isotropic — e.g. the tensile strengths in both the machine and the cross direction are approximately the same. As will be readily appreciated, the uses of oriented nonwoven webs are quite restricted as compared to random webs in that their principle strength lies only in one direction making then unsuitable where a product must have good strength characteristics in all directions.

Many different processes and apparatus are known in the art for producing nonwoven webs; briefly summarized, they may be classified as (1) mechanical techniques (e.g. by carding, garnetting, filament winding), (2) extrusion techniques (e.g. filament extrusion), (3) wet laying techniques (e.g. inclined wire paper apparatus, cylinder paper apparatus, etc.) and (4) air-laying techniques. This invention concerns improvements in the latter classification — i.e. the air-laying techniques, to produce improved random air-laid nonwoven materials.

In brief summary, conventional air-laying techniques for producing nonwoven materials involves opening of fibers from a compressed state, dispersing the fibers in a single high velocity air stream and subsequent condensing (i.e. depositing) of the fibers onto a perforated cylinder or wire screen or belt to produce a web. Thereafter, the web is generally post-treated to provide the required degree of coherency by one or more well known steps, e.g. mechanical or chemical bonding procedures.

In general, air-laying techniques of producing nonwoven webs have several advantages over other types of known web process in its ability to produce a wide variation of lengths and fineness of webs with a wide range of fabric weights, and as well to permit the use of short fibers for different types of products.

Notwithstanding the advantages of air-laying procedures, the present state of technology for producing random nonwoven webs, insofar as their production speeds are concerned, is inferior to other processes for producing nonwoven webs. By way of example, a method that has been used to blend a mixture of long and short fibers into a nonwoven web of randomly oriented fibers involved the step of introducing a mixture of preopened long and short fibers to a single lickerin where the mixture of long and short fibers to individualized. The individual fibers, but still in admixture, are introduced into an air stream and conveyed to a condenser where they were formed into a web. This method has a significant disadvantage in that in order to prevent degradation of the long fibers, it is necessary to operate the lickerin at the optimum speed for the long fibers, which is much below that which is optimum for short fibers. This necessary compromise seriously limited the rate at which the fibers could be processed through this system and this economic disadvantage militates against its use. Also, this method is capable of producing only a single type of web, i.e., a web comprised of a homogeneous blend of long and short fibers.

Another prior art apparatus used to make a nonwoven web that is intended to be a homogeneous mixture of randomly oriented long and short fibers includes the use of a milling device, such as a hammer mill, to individualize the short fibers and a lickerin to individualize the long fibers. The individualized short fibers are entrained in an air stream leading to a mixing zone into which the long fibers are introduced, where the fibers are intermixed. The mixture of fibers is deposited on a condenser to form a web of a random mixture of long and short fibers. In these webs, the intermixed fibers are not completely homogeneously blended; in fact, in such webs, there is more or less of a stratification of the fibers in layers, with the long fibers predominating on one side of the web and the short fibers predominating on the other side. A particular disadvantage of this apparatus was that the hammer mill did not completely individualize the wood pulp fibers and, in consequence, clumps of fibers and/or "salt" resulted. Also, only a single type of web can be produced by this approach.

Langdon U.S. Pat. No. 3,512,218, granted May 19, 1970, and Wood U.S. Pat. No. 3,535,187, granted Oct. 20, 1970, disclose apparatus for producing layered, nonwoven webs, wherein the layers are apparently separated by a thin interface of blended fibers from each layer. In contrast to the present invention, neither patent discloses an arrangement that is capable of producing a web of homogeneously blended different fibers, e.g., textile length and papermaking length fibers, or a web wherein one fiber type predominates at one face of the web and a different fiber type predominates at the other face of the web, with each fiber type generally linearly decreasing in concentration at increasing distances away from the face at which it predominates.

A recent development in this field of air-laying webs has overcome a number of the aforementioned problems in the apparatus previously used and makes possible production of a nonwoven web of a homogeneous mixture of long and short fibers, free from consequential amounts of clumps and salt. The apparatus and method of this development are described and claimed in a commonly owned application filed in the name of Ernest Lovgren on even date herewith.

In the Lovgren apparatus and process, long and short fibers to be blended are individualized separately and simultaneously by separate high speed lickerins, one for each type of fiber, that are operated at speeds optimum for the specific fibers acted upon. For example, in the case of pulpboard, the lickerin is operated in the order of 6,000 rpm to individualize the wood pulp fibers, and the long fibers, the staple length fibers, for example, rayon, are individualized by the lickerin acting on these fibers, operated at a speed in the order of 2,400 rpm. At a speed of 6,000 rpm, rayon fibers are damaged.

In the Lovgren apparatus, individualized fibers are doffed from their respective lickerins by separate air streams. The fibers are entrained in the separate air streams and the air streams are subsequently intermixed in a mixing zone to homogeneously blend the fibers entrained therein. The homogeneous blend of fibers is then deposited in random fashion on a condenser disposed in proximity to the mixing zone. The air streams generated by the high speed operation of the lickerins and by a suction fan located in the condenser, which acts to draw air past the lickerins, convey the fibers to the condenser.

While the Lovgren apparatus represents a substantial advance in the art, the apparatus has limitations in that it does not lend itself for use in making a wide variety of webs.

In accordance with a still further recent improvement, as described and claimed in a commonly owned application filed in the name of Allan Farrington on even date herewith, and extremely flexible process and apparatus are described for producing a wide variety of nonwoven, air-laid isotropic webs made up of a substantially uniform mixture of long and short fibers, or of two different kinds of long or short fibers. In accordance with the Farrington process, the following types of webs can be produced; (1) a web comprised of a homogeneous blend of fibers from two different fiber sources, (2) a web having outer layers comprised of fibers from two different fiber sources and an intermediate layer that is a blend of the fibers from each sorce, and (3) a web of two layers of fibers from each fiber source, with the layers being interlaced only at the region of their interface.

In certain instances it is desirable to provide webs having different properties at their opposite faces. Two such types of webs have been produced by the Farrington invention, as summarized in the preceding paragraph. While such webs represent a significant improvement over known prior art webs within it was necessary to bond two layers having different types of fibers in order to provide different properties at the faces of the web, it is desirable to provide a web with each face consisting of a blend of different types of fibers. This latter type of web, which can be provided by the process of the present invention, retains the advantage of being able to have different properties at opposite sides of the web, since each face can have a predominance of fibers of a type that will give a desired property. At the same time, this latter web can add those advantages that can be attributed to a blend of fibers at each face.

While the Lovgren and Farrington inventions discussed above represent a marked advance in the art, at the air to fiber volume ratios utilized therein, it was not always possible to consistently produce high quality webs at high production speeds. The present invention remedies this need, and in this regard, it has been discovered that by providing an air to fiber volume ratio in the range of about 12,000:1 to 275,000:1 in the combined air stream, extremely uniform webs can be produced at high production speeds up to 550 feet per minute or greater.

In accordance with one aspect of this invention, applicants have provided an improved process for producing random nonwoven webs by an air-laying technique which now only overcomes the problems associated with prior art air-laying techniques, but at the same time, provides very advantageous features of its own by enabling a uniform web to be produced at high production rates.

In accordance with a further aspect of the present invention, there is provided a novel nonwoven product wherein the product is characterized by having a predominance of at least one fiber type on one face of the product and a predominance of at least one different fiber type on the other face of the product with a transition zone between the faces such that the fiber type which predominates at one face diminishes in predominance, from the face at which it predominates, to the face at which the other fiber type predominates.

More particularly, in accordance with the process of the present invention, in air-laying processes for preparing random nonwoven webs which include the steps of individualizing fibers from separate fiber sources, suspending the fibers from each source in separate gaseous streams, impelling said gaseous streams at least initially toward one another and combining said streams to form a single combined carrier stream wherein the fibers from each gaseous stream intermix with one another, there is provided the improvement whch comprises providing in the combined gaseous carrier stream a total gas to total fiber volume ratio of at least 12,000:1, and condensing the entrained and individualized fibers from said combined stream to form a random nonwoven web. At gas to fiber volume ratios above 12,000:1 the fibers in the individual streams are spaced sufficiently from one another that if streams are brought together at an angle without substantial diminution in the velocity of the streams, a majority of the fibers in each stream can cross over the oncoming fibers to produce the novel product of the present invention.

In carrying out the process of the present invention, at least two individual and separate gaseous streams are employed which entrain individualized fibers therein, with the individual streams thereafter being combined at a common region to form a common gaseous carrier stream from which the entrained and individualized fibers are condensed. Depending on the method of introducing the fibers in each stream — as for example by doffing the fibers from a fiber opening means, in addition to serving as a doffing stream each gaseous stream also serves as a carrier stream from which the entrained and individualized fibers are subsequently condensed. The use of at least two gaseous streams in the process has been found to permit vastly improved production speeds amongst other advantages, either where the same type of fibers are suspended in each gaseous stream, or where different types of fibers are suspended in its different steams. Thus, with this invention, at least two fiber sources are transported in an individualized state, each in a separate gaseous stream; and if desired several different fiber sources, e.g., three or four, may be entrained in an individualized state in each separate gaseous stream, to ultimately provide random nonwoven webs consisting of a mixture of several different fiber types.

The gaseous streams employed in the present invention may be composed of any suitable gaseous medium not detrimental to the fibers; and although for economical reasons and availability the gaseous streams are preferably composed of atmospheric air, other gaseous mediums may be employed as desired.

The step of introducing fibers into each gaseous stream can, according to the process of this invention, be carried out by any suitable technique commensurate with providing fibers in a suspended and substantially individualized state in each stream. A particularly preferred embodiment for providing suspended and individualized fibers for each stream consists in providing a fiber source, opening the fibers in said fiber source by combing the fibers with suitable means — e.g., rotatable means such as a lickerin having fiber opening teeth thereon, and doffing the opened or combed fibers with a gaseous stream to provide in the stream suspended and individualized fibers. However, the opening and entraining of the fibers from a fiber source in the gaseous stream, may also be carried out according to other techniques known in the art. As used herein, the term "individualizing" or "individualized" is used to mean that the fibers are maintained in a substantially separate or individual condition. However, the degree to which the fibers are placed and maintained in an individualized state may vary depending on the quality of the web desired; it is preferred that the degree of fiber individualization be such that upon condensation, the product has a uniformity within the values hereinafter defined.

In accordance with the process of the present invention, applicants have found that if the combined carrier stream formed by the joinder of the individual has a volume ratio of total gas to total fiber of between about 12,000:1 to about 275,000:1, the maximum advantages of the process are obtained and high quality random nonwoven webs are produced. To this end, each of thd individual streams will thus possess a volume ratio of gas to fiber, such that when these streams are combined, there is provided a total gas to total fiber ratio within the above range. Most desirably, the volume ratio of each individual stream is within the same range as the above ratio — i.e. 12,000:1 - 275,000:1.

The process of the present invention, operating within the above and other parameters as defined hereinbefore and hereinafter, contrast with conventional prior art techniques of forming nonwoven webs where very low gas-fiber volume ratios, generally well below 5,000:1, were employed. With gas-fiber volume ratios well below 5,000:1, the type of fiber capable of being employed in such processes is very limited, in addition to the fact that the speed at which the nonwoven webs can be produced was likewise very low. In contrast, by employing the above volume ratios, of gas to fiber, in the process of the present invention, it has been found that these shortcomings of the prior art, as well as others, can be overcome to provide high quality webs. Thus, within the process of the present invention, at volume ratios below 12,000:1 (gas to fiber), web uniformity (as hereinafter defined) becomes unacceptable at high production rates for high quality products; while on the other hand, at volume ratios above 275,000:1 (gas to fiber) no further benefits are evident with the degree of uniformity being substantially constant.

Within the volume ratios of gas to fiber of the process of the present invention, the specific ratio employed will vary depending on the type and length of fibers used in the process. Thus, for example, for most commercially available shorter type fibers, lower volume ratios may be employed as compared to the use of staple of longer length fibers where higher volume ratios are desirably employed. To this end, when shorter type fibers form the total fiber content of the combined stream, the volume ratio of gas to fiber of the combined stream is at least 12,000:1 to 15,000:1, up to 275,000:1, with each individual gaseous stream in which the fibers are suspended in an individualized state likewise having a similar volume ratio of gas to fiber. In the case where staple or longer length fibers form the total fiber content of the combined stream, the volume ratio of gas to fiber in the combined stream preferably has a minimum of from about 15,000:1 to 18,000:1, and up to 275,000:1 (desirably between 100,000:1 to 275,000:1), with each individual gaseous stream in which the fibers are entrained in an individualized state having a similar ratio.

Still further, when the combined stream contains short and staple or longer length fibers, the minimum gas to fiber volume ratio, within the above limits of the present invention, will vary depending on the proportion of each type of fiber — i.e. short or long, so that for any particular proportion the volume ratio will be chosen to satisfy the requirements. In this case also, the volume ratio of gas to fiber in the individual streams in which the different fiber types are fluidized and in an individualized state, will most advantageously by within the above preferred minimum ratios for the respective fiber types. As will be understood by those skilled in this art, having regard to the above and subsequent teachings, the particular volume ratio required for the combined stream, and likewise most desirably for the individual streams, can be determined by calculating the appropriate fiber volume to arrive at the appropriate gaseous volume required.

In carrying out the process of the present invention, the velocities of the individual gaseous streams and the combined gaseous carrier stream, may be varied within wide ranges depending on such factors as, for example, speed of web formation desired, thickness of web, the percentages of different fiber types desired in the condensed web, the type of fiber, equipment restrictions, etc. In all cases, however, the velocity of each gaseous stream will most preferably be, at least in the area of fiber introduction into each stream, greater than the speed at which the fibers are introduced to maintain the fibers in a suspended and individualized state, and to prevent fiber clumping. Thus, were the fibers are being introduced in each stream by doffing a comb-toothed member such as a lickerin, the velocity of the gaseous stream that doffs the fibers from each lickerin should be greater than the speed of rotation of the lickerin — i.e. the speed at which the fibers are being combed from the fiber source. To this end, the velocity of the gaseous streams may be increased to the desired level in the area where the fibers are doffed by creating a venturi effect in the flow path of the gaseous stream; however, it is preferred that the velocity be maintained substantially constant across the width of the lickerins and the combined stream to achieve a uniform product.

Following fiber introduction, the individual gaseous streams, at least initially, are impelled toward one another with substantial velocity, and the fibers entrained in each gaseous stream have an initial trajectory that corresponds generally with the direction of movement of the individual gaseous streams, so that once the individualized fibers are entrained in their respective streams, they are also impelled toward one another. Subsequent to entrainment of the fibers in their respective streams, the flow paths of the streams are controlled to bring them together in a common zone to combine the streams into a common carrier stream. The gaseous streams preferably intersect one another in the common region at an angle of less than 180° to avoid any fiber clumping.

The specific angle at which the individual gaseous streams intersect one another, coupled with the trajectory of the fibers entrained within the streams, controls the type of web that will be produced when the fibers are condensed from the common stream. For example, when the individual gaseous streams intersect one another at a fairly substantial angle, e.g. 90°, since the fibers entrained in each individual stream have substantial kinetic energy by virtue of their mass and velocity, they will continue to move generally in the direction of their initial trajectory. Because of the relatively large spacing between the fibers at the gas to fiber volume ratios of the present invention, a majority of the fibers in the streams will tend to cross over the oncoming fibers in the region where the individual streams are combined. In this manner, it has been found that, within the general process conditions hereinbefore and hereinafter described, a novel product is produced having a predominance of at least one fiber type at each face, with a transition zone of decreasing prominance between the respective faces of the resulting product. The extent to which the fibers of each individual stream cross over the fibers of the other stream determines the extent to which each fiber type predominates at the surface of the resulting web. Thus, the degree of cross-over may be varied, as desired, to provide a product having the desired characteristics by providing sufficient spacing between the fibers in the individual gaseous streams, the trajectory of the fibers, the angle and region of the combination of the individual streams and the energy inparted to the fibers. In a preferred embodiment, about 55 to about 95% (by weight) of the fibers in each gaseous stream cross over the fibers in the other gaseous stream to thereby produce a product having a predominance of from about 55 to about 95% of the respective fiber types at each surface.

The process of the present invention also contemplates the production of a web of homogeneously blended fibers, i.e. a web having balanced strength properties in both the machine and cross directions. This may be accomplished with the gas-fiber volume ratios mentioned above by interposing a flow controlling member, such as a baffle, between the individual gaseous streams to prevent the fibers entrained in each stream from crossing over one another, and positioning the baffle a sufficient distance above the fiber condensing means to allow the fibers to be substantially completely intermixed before they are deposited on the condensing means. By varying the baffle between a position wherein a majority of the fibers in each gaseous stream cross over one another and a position wherein none of the fibers from each stream cross over one another, a wide variety of webs can be produced wherein the degree of concentration of the fibers throughout the web can be varied and controlled.

The degree to which different fibers will mix for any given set of conditions, will depend to some extent on the charactistics of the fiber types as for example, diameter of the fibers, stiffness, length, crimp and electrostatic properties. The extent of mixing is also determined, to a certain extent, by the length of the flow path of the combined gaseous stream, as determined by the energy imparted to the fibers as they are doffed. This energy level is created by the velocity of the individual gaseous streams in conjunction with the velocity given to the fibers by the peripheral speeds of the lickerins.

The step of condensing the entrained fibers from the combined gaseous carrier stream may be carried out by conventional procedures well known to those skilled in the art. To this end, the combined gaseous stream containing the entrained fibers may be passed over a selectively permeable cylinder (permeable to the gaseous stream but impermeable to the fibers); alternatively, a movable wire screen or conveyor belt also permeable to the gaseous stream but impermeable to the fibers may be employed. The depth to which the fibers are condensed or deposited from the combined stream to form the nonwoven web, may be varied by varying the speed at which the take-away means removes the condensed web — thus, the thickness of the web may be readily varied to form a random nonwoven web of a desired thickness.

Most desirably, the flow path of the combined gaseous stream is such that a controlled, at least generally (preferably substantially) uniform flow path, as opposed to a random uncontrolled flow path, exists across the width of the machine since with a random uncontrolled flow path it has been found that fiber concentration may increase to undesirable limits and in some cases depending on the degree of flow variation, create fiber concentration, which would not be acceptable for uniform high quality webs.

The process of the present invention may be employed to produce nonwoven materials having a very high degree of uniformity, as indicated by a co-efficient of weight variation (hereinafter referred to as C.V.) of the products. As used herein, the C.V. value of a given nonwoven material is defined as being the co-efficient of weight variation of the material per square foot, and determined by utilizing 40 equi-size five-eighths inch substantially circular samples of a square foot of material, the samples being derived from the material on 2 inch centers (sample to sample) in a first direction and on 1.5 inch centers (sample to sample) in a second direction at right angles to the first direction. Each circular sample is then weighed, and as well, the total weight of all samples; the C.V. value may then be obtained by the following equation:

$$C.V. = \frac{\text{Standard Deviation of Weight}}{\text{Average Weight of Total Samples}} \times 100 = \%$$

Thus, for any given C.V. percentage, the value obtained represents the percentage of weight variation or uniformity for any given sample of nonwoven material, calculated on a per square foot basis.

With the process of the present invention, products having a C.V. value of less than 10%, and down to as low as 6% or less, can be obtained. For commercial reasons, the products produced by the process of the present invention desirably have a C.V. value of less than about 16% in general, and where such products are used for surgical or similar purposes, the nonwoven materials preferably have a C.V. value of below 10% and desirably 6%.

If textile length fibers are used in the process of the present invention, the length of the fibers in the condensed nonwoven web may be varied as desired by varying one or more conditions in the process. These conditions include (*a*) the method used to open the fibers from the fiber source, (*b*) the rate at which the fibers are opened and entrained, and (*c*) the method of feeding the fiber source to the fiber opening means. The fiber lengths in the finished web may also vary to some extent, particularly at higher rates of web formation, on the rate of feed of the fibers to (*c*) above.

In the case of shorter length fibers, such as wood pulp fluff, the fiber length need not be controlled to any great extent because of the inherent shortness of the fiber; however, in the case of longer length fibers, the above relationship may be varied as desired to provide predetermined fiber lengths in the condensed random nonwoven web.

At higher feed rates, the length of the fiber in the resulting condensed web has been found to be generally independent of the rate of feed of the fiber source to the fiber opening means, although at higher feed rates, the resulting condensed web has increasing amounts of nips or nodules of unopened and/or recompressed fiber. Thus, the quantity of nips and nodules may be controlled at higher rates of feeding, where the number will vary according to the rate of feed to some degree.

The physical characteristics of weight and thickness of the random nonwoven web produced by the process may be varied as desired for a given quantity of fibers being condensed, based on the web take-away speed. Thus, the web thickness can be increased by decreasing the web take-away speed and/or weight, or the web take-away speed may be increased by decreasing the weight and/or thickness.

The present invention permits the use of a wide variety of fiber types, as well as mixtures of fibers, for the production of te random nonwoven materials. To this end, the web may be composed of 100% short fibers or conversely 100% "staple" and longer fibers or mixtures of short and staple length fibers in any desired proportions.

The choice of fibers used will depend on the desired characteristics of the product and as well, its utility. Thus, for example, the product may require one or more characteristics such as tear resistance, abrasion resistance, washability and stretchability, burst strength, absorption or nonabsorption to different liquids, heat sealability, ability to resist delamination, etc., all of which will influence the type of fiber or mixture of fibers to be used. Thus, by way of specific example, absorbent products requiring strength characteristics may be a combination of two or more different fibers such as wood pulp fibers and rayon or similar fibers in varying percentages.

Likewise, again depending on the nature of the product desired, the product may have to possess substantially random characteristics as opposed to oriented fiber characteristics in order to provide for balanced properties in both the machine and cross direction for most uses. For example, in the case of products intended for surgical or similar uses requiring absorbency characteristics, such as covering layers for sanitary napkins, absorbent layers for surgical drapes, etc., mixtures of shorter and long fibers are normally used to provide improved mechanical characteristics; while in the case of nonwoven materials suitable for use as disposable items in the field of diapers, shorter fiber lengths may be employed.

Typical of the short fibers are wood pulp fibers from various types of woods, cotton linters, asbestos fibers, glass fibers and the like; with wood pulp fibers being those which find most frequent use in a large variety of products due to their ready availability and economical attributes. Typical of the staple fibers include both synthetic and natural fibers; synthetic fibers such as cellulose acetate fibers, vinyl chloridevinyl acetate fibers (e.g. the product marketed under the trademark "VINYON"), polyamide fibers such as NYLON 6, NYLON 66, etc., viscose staple rayon, cupraammonium rayon or other regenerated cellulose fibers including saponified ester fibers, cellulose ester fibers such as cellulose acetate and cellulose triacetate, acylic fibers, polyester fibers, polyvinyl chloride fibers, polyolefin fibers such as polyethylene and polypropylene, fluorocarbon fibers such as "TEFLON" and natural fibers such as cotton, flax, jute, wool, silk, ramie or "rag," or protein fibers such as "VICARA". Combinations of any of the above typical short and staple or long fibers may thus be employed in this invention. The denier of the fibers used may vary over a wide range and may be from ½ to 100 depending on the type of fiber employed and the requirements of the nonwoven material. Commonly, when using staple fibers such as rayon, the denier will vary from 0.75 to 5 or 6 denier.

Conventionally, the shorter type of fibers such as wood pulp fibers are commercially available for air-laying processes in the form of pulpboards, which are compressed sheets of fibers in intimate contact with each other. The pulpboards come in varying thicknesses and lengths, typical thicknesses being from one-sixteenth of an inch to three-quarters of an inch or more. If desired, the starting material such as boards, may be comprised of a mixture of two or more different fibers, preferably of approximately the same length. Thus, by way of example, in place of utilizing a pulpboard, a board may be of a mixture of pulp and cotton, asbestos fibers, glass fibers etc. Thus, different properties may be imparted to the product by employing such combinations of fibers.

In the case of staple or longer length fibers, such as rayon for example, they are normally commerically available in bale form in various fiber lengths; and for use in the present invention, they are generally employed in a preopened oriented condition, termed a "carded web" or "carded batt" in the art. To this end, baled rayon can be formed into a carded batt according to conventional techniques known to those skilled in the art, which briefly summarized, first involves formation of a picker lap wherein the fibers are formed into a uniform batt of generally constant weight, whereafter they are then carded to orient and open and comb the fibers, and thus form the carded batt. If desired, in place of using a carded batt of only rayon, a mixture of rayon and other fibers, or for that matter a mixture of any two or more different fibers can be employed thereby providing a product having different fibers in it to impart different properties. Thus, rayon, silk fibers, polyester fibers, etc., may be formed into a carded batt and thus introduce into the produce such combinations of fibers as may be desired. It is not necessary that the staple length fibers be used in the form of a carded batt but could be presented to the machine by other means well known to those skilled in the art such as chute feeding.

In the case of the novel products of the present invention, the nonwoven material, in web form as produced by the process described herein, has conventionally a pair of opposed major faces. These faces, as outlined hereinbefore, are each characterized by having a predominance of at least one fiber type at the respective face, with the transition zone between the opposed faces being characterized by a decreasing predominance of the respective fiber type from the face at which it predominates to the opposite face of the product.

The preferred form of the novel products of the present invention is where the nonwoven material is comprised of a majority amount by weight of a first fiber type or group and a minority amount, by weight of a second fiber type or group interspersed and blended therewith with the opposed major face being comprised of a majority amount, by weight of the second fiber type or group, and a minority amount of the first fiber type interspersed and blended therewith. In this preferred type of product, each fiber type or group forming the majority amount of the fibers on each face, calculated on a weight basis, is preferably present in an amount of from about 55 to about 95% higher, desirably 60 to about 90%, with the minority fiber type or group forming an amount of from about 45 to about 5%, or less, desirably 40 to 10%. The preferred product includes a substantially continuous fiber transition zone between each opposed face, wherein the fiber type or group which predominates at a face, substantially uniformly diminishes on a weight basis to the other face at which it comprises a minority amount of the fiber blend, by weight. As used herein, the percentages of the fibers of each fiber type at the opposite faces of the product may be determined by measuring the initial 5% thickness of the web and calculating the weight of each fiber type.

By use of the term "substantially uniform" in describing the transition of each fiber type from the opposed faces of the nonwoven fabric, it is meant that at any given point between the opposed faces, there is substantially no clear-cut or distinct line of demarcation between the fibers of the fabric, when the fabric is viewed in cross section.

The above novel products, made from fiber types such as those hereinbefore described, and wherein the fiber type predominating at each surface of the nonwoven material is selected so as to provide desired characteristics at each surface, results in unique nonwoven material particularly suited for applications where it is desired to have different functional or physical characteristics on opposed sides of the material. Thus, for example, the nonwoven product may have opposed faces each of which has a property such as cohesive strength, abrasion resistance, absorption characteristics, nonabsorption characteristics, etc. Accordingly, the fibers selected for the nonwoven fabric will be so chosen to provide such charcteristics or others as desired. In this respect, similar fiber types may be employed as, in the case where one fiber has been modified to change its physical and/or chemical characteristics.

As mentioned above, the novel products of the present invention, may be made from blends of two or more fiber types, in which the amount of each fiber in the blend may vary. This will in turn influence the amount of fiber predominating at the respective surfaces of the material. Thus, for example, nonwoven products may be made from varying percentages of the different fibers — for example, blends of 50% rayon fibers and 50% pulp fibers, or from 60/40% rayon/pulp, etc.

The thickness and weight of the novel nonwoven products of the present invention, as well as those of the products produced in general, will vary depending on conventionally commercial requirements; typically, they will be in the order of from about several hundred grains to several thousand grains per square yard, with a thickness of from about 1/32nd to about 1 inch or more prior to any post-treating operation.

As produced by the process of the present invention, the nonwoven products in general, including the novel nonwoven materials, are of a substantially random nature at the time of web formation in the process; however, if desired, the products may be treated to provide any desired machine direction; cross direction (MD:CD) required for final product usage. Thus, for example, the MD:CD ratio may vary between, for example, 1:3 to about 5:1, those products having a ratio of between 1:3 to about 3:1, and preferably closer to unity, are particularly preferred for various applications as hereinbefore and hereinafter described.

The nonwoven webs obtained by the process of the present invention may be post-treated by any suitable conventional technique, e.g. mechanical or chemical, to bond the web and provide the required strength and coherency characteristics for a given product. The particular type of bonding technique chosen will depend on various factors well-known to those skilled in the art, e.g. the type of fibers, the particular use of the products, etc. To this end, typical of the conventional techniques are web saturation bonding, suction bonding, foam bonding, print bonding, fiber bonding, fiber interlocking, spray bonding, solvent bonding, scrim bonding, viscose bonding, mercerization, etc.

In the case of web saturation bonding, the nonwoven web is generally soaked with a solution or emulsion adhesive, and thereafter, the excess fluid is removed usually by mechanical means (e.g. squeeze rollers and/or vacuum), followed by evaporation. In the case of suction bonding, a web is treated with a suitable binder by soaking and the excess removed by means of a vacuum apparatus. In foam bonding, which is a variation of saturation bonding and is particularly useful for products requiring good bulk and through-bonding, a foam binder is employed. In print bonding, generally employed where softness and absorbency is required, a bonding agent will be printed onto the web by e.g. gravure type rolls. The web can be wet or dry when printed and generally the binder is a water, solvent or plastisol based one.

In fiber bonding techniques, employed where a percentage of the fibers in the web are semi-soluble in certain solvents e.g. hot water, the web may be bonded by adhesive or by treating the web with a suitable — e.g. polyvinyl alcohol. In a variation of this procedure, if the web includes thermoplastic fibers such as polypropylene, "VINYON" or low melting polyester, hot roll embossing calendars may be employed. Still further, in other cases, a low melting spun bonded web may be placed between higher melting fiber webs and hot calendered. Thermoplastic powders may also be used in this technique.

In the case of mechanical interlocking bonding techniques, needle looms ae employed in bonding soft fiber webs. Boards of needles with barbs downwardly pointed perforate the web and entangle the layers. A variation of this type of bonding technique is stitch bonding with yarn, as may be accomplished by using an "ARACHNE" apparatus or with the fibers of the web itself.

As the name implies, spray bonding techniques spray a binder onto the web which is subsequently passed into a drying chamber. This type of bonding is particularly useful where high loft is required in products, e.g. which are suitable for use as air filters. Solvent bonding employs a solvent which is applied to the web to soften the fiber surface and render it adhesive. Typical solvent bonding employs the use of chloral hydrate of DMSO (dimethylsulfoxide).

In scrim bonding, a scrim layer or yarn layer act as carriers for a wet or thermoplastic adhesive used to laminate the nonwoven webs to one or more layers of a substrate e.g. tissue. In viscose bonding, which is a special case of print or saturation bonding, cellulose xanthate is regenerated to pure cellulose on the inner sections of the fibers forming the nonwoven web. In a like manner, acid solutions of nylon may be regenerated in situ.

In mercerization bonding techniques, nonwoven webs are bonded using the uncurling manner of caustic solutions e.g. caustic soda on all-cotton nonwoven webs. The fibers unwind to entangle each other and, thereafter, the resulting product is thoroughly washed.

The above list of bonding techniques is not intended to be exhaustive as others known to those skilled in the art may be employed, e.g. bonding with the use of high pressure streams of water or other fluids directed onto the nonwoven web to cause the fibers to interlace; or still further, using ultrasonic waves and laser beams.

In any of the above "dry" bonding techniques, the binder areas may be of any suitable shape and size and may be continuous or discontinuous straight, sinuous, curved, or wavy lines; rows of polygons, circles, annuli, or other regular or irregularly shaped geometric figures; all of which normally extend across the width of the nonwoven fabric at various angles to the long direction thereof. Specific examples of such binder areas are noted in U.S. Pat. Nos. 2,705,688; 2,705,687; 2,705,498 and 3,009,822.

The amount of binder employed will depend on the type of bonding techinque used and depend on the type and quality of product desired — i.e. the amount of binder add-on to the non-woven web may be varied according to the technique employed and will vary within relatively wide ranges, depending to a large extent upon the intended use of the nonwoven fabric, upon its type, weight and thickness, as well as upon the specific binder employed. Typically, the binder areas should not exceed a substantial amount of the total surface of the nonwoven fabric, if a soft hand, drape and other textile-like properties and characteristics are desired or required. In cases where a somewhat different hand and drape is acceptable, increased binder coverages of up to almost any value, say 50 or even 75%, are useful. For some binders, as low as from about 2 to about 20% by weight has been found sufficient; for others, as high as from about 40 to about 70% or more by weight has been found preferable. Within the more commercial aspects of the present invention, however, binder add-ons of from about 3 to about 40% by weight are known in the art to be satisfactory.

The particular type of binder used may be selected from a large group of binders now known in the industry for such purposes. Non-migratory binders, such as hydroxyethyl cellulose and regenerated cellulose, are preferred inasmuch as they yield sharp and clear boundaries of bonded areas and unbonded areas. Water-insoluble or water-insensitive binders, such as melamine-formaldehyde, urea formaldehyde, or the acrylic resins, notably the self-cross-linking acrylic ester resin, are also preferred inasmuch as they are capable of completely resisting a subsequent aqueous rearranging treatment. Other binders, however, are also of use and would include polyvinyl acetate, polyvinyl chloride, copolymers thereof, polyvinyl acrylate, polyethyl acrylate, polymethyl methacrylate, polyvinyl butyral, cellulose acetate, ethyl cellulose, carboxymethyl cellulose, etc.

Following bonding, the nonwoven webs may be treated again according to conventional procedures for any further desired purpose, such as for decorative reasons.

Still further, the nonwoven webs may be treated with various types of resinous coatings according to conventional techniques, or alternately by bonding the nonwoven web to various substrates to provide laminates.

The products obtained by the process of the present invention, following bonding, find use in various and diverse fields. Moreover, the random nonwoven webs will now have greater utility because of their greater availability, and may be used to replace oriented nonwoven webs where improved machine and cross direction strength ratios are required. Typical of the uses to which the products can be put include limited-wear garments such as dresses, medical and industrial apparel, caps, hospital uses such as for surgical products, e.g. bandages, alcohol preparation, towelling, surgical pad covers, sanitary products such as napkins, absorbent products such as diapers and diaper facings, headrest covers, towelling such as duster cloths, polishing and buffing cloths, wash cloths, wiping cloths, etc., consumer products such as table cloths and place mats, serviettes, book jackets, labels and tags, mop covers, cosmetic pads, filtration uses such as air filtration media as well as liquid filtration media in the chemical and food industries, etc. This is not exhaustive and many different uses are well known to those skilled in the art.

The process of the present invention has many advantageous features over prior art air-laying processes for producing random nonwoven webs including, for example, the fact that it produces a random nonwoven web wherein the machine direction and cross direction strengths are in a ratio of 1:1, while at the same time, producing high quality webs generally of less than a 10% C.V. for a given web. Still further, the advantages are coupled with a very high degree of uniformity in web structure. The process of the present invention is capable of operating at speeds of up to 550 feet per minute or greater, depending on web thickness and fiber type, may times the speed associated with conventional procedures for producing similar nonwoven webs, while varying, as desired, the fiber length in the random web. The process of the present invention further permits the use of fibers, and mixtures of fibers which were difficult, if not impossible, to use in conventional air-laying techinques.

The process of the present invention may be carried out by employing suitable apparatus providing the previously described requirements. A preferred apparatus for this purpose includes (1) two fiber opening means, each comprising rotatable comb-toothed means rotatable about a fixed axis with a plurality of fiber engaging teeth thereon adapted to comb or open and fluidize a fiber source, (2) means for rotating each of said rotatable means, (3) means for feeding to each of said fiber opening means a source of fibers, (4) means for establishing a gaseous doffing and carrier stream for each of said fiber opening means, (5) means for combining the gaseous streams at a point downstream, in the flow direction, from said fiber feeding means, the combined gaseous stream having a volume of gas to total fiber of at least 12,000:1, and (6) condensing means for condensing entrained and individualized fibers from the combined gaseous stream.

The foregoing advantages and numerous other features and advantages of the invention will be more readily understood and appreciated in light of the following specification, taken in conjunction with the accompanying drawings, in which.

DETAILED DESCRIPTION OF THE INVENTION

Figure 1:
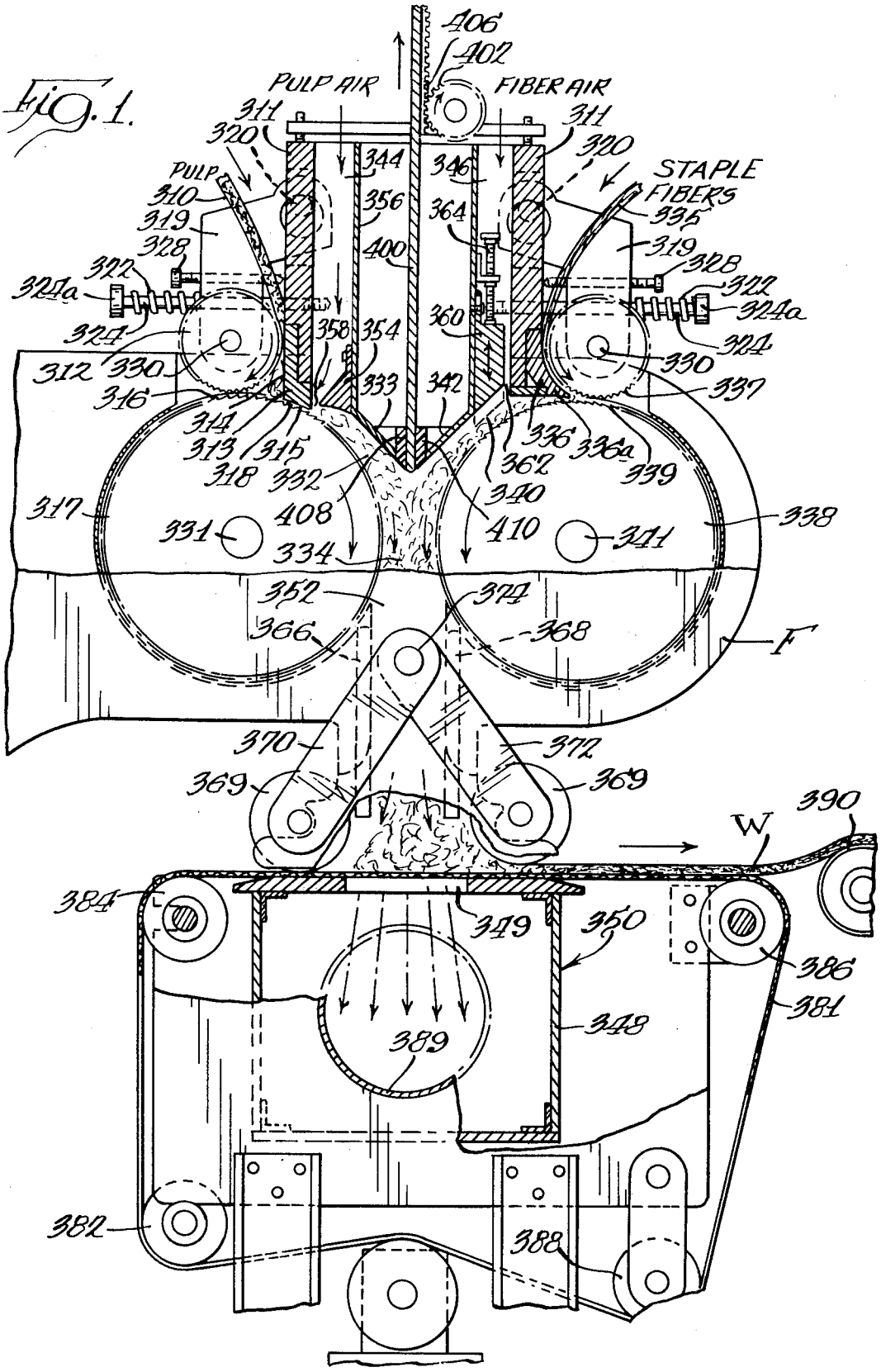
FIG. 1 is a cross-sectional view showing the main components of the apparatus forming part of the instant invention as taken along line 1—1 of FIG. 2.

While this invention is susceptible of emboidment in many different forms, there are shown in the drawings and will herein be described in detail only preferred embodiments of the invention, with the understanding that the present invention is to be considered as an exemplification of the principles of the invention and is not intended to limit the invention to the embodiments illustrated. The scope of the invention wil be pointed out in the appended claims.

For purposes of example, the novel process and product of the present invention are illustrated and described in connection with the apparatus disclosed and claimed in the above-mentioned Farrington application. Referring to FIG. 1, there is illustrated a cross-sectional view of the web forming apparatus with parts broken away to show the relationship between the various components thereof. The apparatus will be illustrated and described as being used for blending wood pulp fibers and rayon, but it could obviously be used to blend two different fibers, or identical fibers.

In the drawings, the apparatus includes a main frame and subframe components, which, for the sake of simplicity and brevity, will be identified by reference letter F.

Reference will first be made to the left-hand, or wood pulp side of the system.

Wood pulp is introduced into the system in the form of a pulpboard 310, which is directed between a plate 311 and a wire wound feed roll 312. Connected to the lower part of the plate 311 is a nose bar 313 for providing an anvil against which the pulpboard is directed during the individualizing step. The nose bar 313 has a sidewall 314 that can be made relatively flat, since due to the integrity of the pulpboard, it is unnecessary that the nose bar 313 be designed to more precisely direct the pulpboard to the lickerin 317 that is used to individualize the pulpboard into short fibers. The bottom wall 315 of the nose bar 313 is angularly disposed relative to the sidewall 314 and is spaced a short distance from the teeth 316 of the lickerin 317 to define a passage 318 through which the pulpboard is moved during the individualizing operation. The pulpboard is individualized into short wood fibers by the teeth 316 of the lickerin 317 acting on the pulpboard directed into position to be contacted by the teeth by the nose bar 313.

The feed roll 312 is journalled in a bracket 319 that is eccentrically mounted at 320 to permit adjustment of the feed roll relative to the pulp lickerin 317 and nose bar 313. The bracket 319 and feed roll 312 are resiliently biased to direct the pulpboard toward the nose bar 313 by a spring 322 that is located between bracket 319 and head 324*a* of bolt 324 that extends through a hole in the bracket 319, and is secured in place in plate 311. The pivotal movement of the bracket 319 is limited by a set screw 328 that is threaded into and through bracket 319 and engages plate 311. The spring 322 biases feed roll 312 into contact with pulpboard 310 to insure that the pulpboard is fed into position to be engaged by lickerin teeth 316. This design accommodates varying thicknesses of material that can be used in this system.

Figure 2:
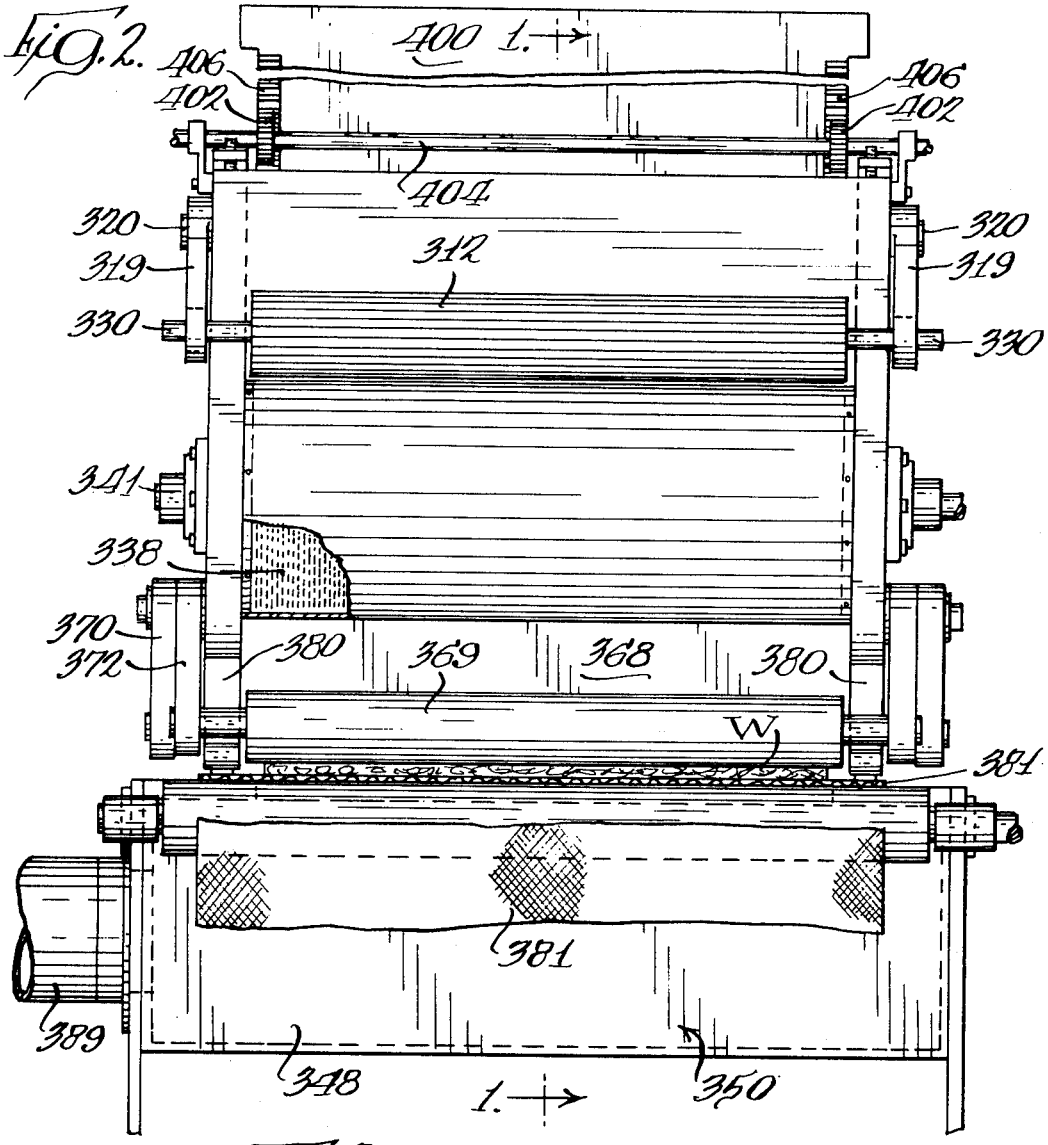
FIG. 2 is an end elevational view of the apparatus illustrated in FIG. 1.
Figure 3:
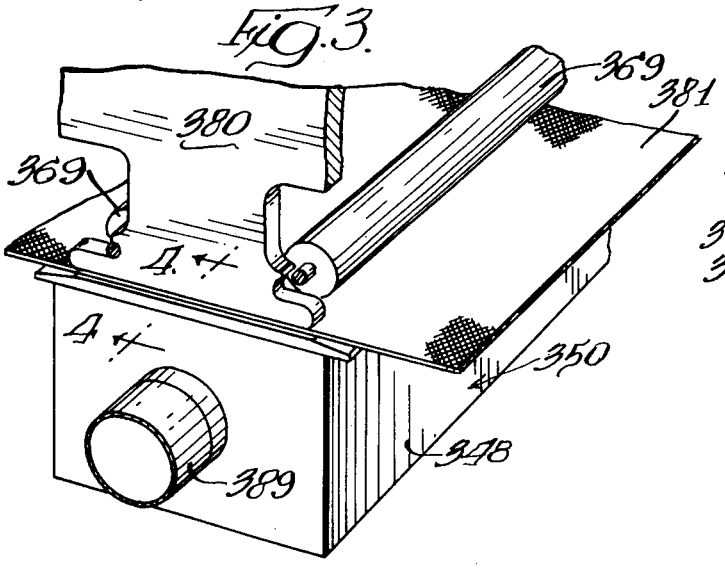
FIG. 3 is a fragmentary perspective view, partially in section, showing a portion of the condenser.

The feed roll 312 is secured to a shaft 330 that is suitably supported for rotation by a variable drive means, a portion of which is shown schematically in FIG. 2. The details of the drive means are not important to the present invention. The speed at which the feed roll is operated is determined by the rate at which pulp is to be fed into the system. A number of the mechanisms employed for supporting the rolls, lickerins, and so forth, are shown generally in FIG. 2 and they will be referred to when they will aid in understanding the present invention.

During the operation of the illustrated apparatus, the pulpboard 310 is fed into position to be engaged by the lickerin teeth 316 adjacent the nose bar 313. The lickerin 317 is mounted on shaft 331, which is driven at a very high speed by suitable drive means to individualize the pulpboard into short fibers. In an exemplary embodiment, the lickerin 317 is driven at a speed of 6,000 rpm. and produces a large throughput of pulp fibers without adversely affecting the fibers.

The lickerin teeth 316 fray the pulpboard until the fibers are loosened therefrom, after which the teeth comb the short fibers out of the board. The clothing on the lickerin is designed to act on the particular fiber and as the optimum tooth profile for the specific material it is processing. Each successive tooth has more opening action than the one before, which facilitates individualizing and when operated at an optimum speed greatly minimizes, if not totally prevents, clumps and salt from being extracted from the board.

The pitch and height of the teeth used on the lickerin for the pulpboard may vary, good results being obtained with a tooth pitch of about 3/32 inch to about one-half inch and a tooth height of about 3/32 inch to about one-half inch. The angle of the teeth of the lickerin for the pulpboard may also vary, generally within the limits of about −10° to about +10°. A positive angle for the teeth of the pulpboard lickerin which is standard in the industry, viz., +10°, may be used in accordance with the invention, but this is not preferred. In general, it is preferred that the angle of the teeth be positive and be below +10°.

After the wood fibers are individualized by the lickerin 317, they are entrained in an air stream and directed through a duct 332 formed between the lickerin teeth 316 and a sidewall 333, which duct 332 leads into a mixing zone 334.

Referring now to the rayon fiberizing system which is illustrated on the right hand side of FIG. 1, there are shown mechanisms that control the feeding of the rayon to the system. A number of the mechanisms used in processing the rayon are similar to those used on the pulp side of the system and where they are identical they are given the same numbers.

The rayon, which usually comes in the form of a carded batt 335, has no integrity and must be positively directed to the clothing of the rayon lickerin 338 to insure that the rayon lickerin teeth 339 will pick the rayon up from a rayon source 335. To this end, the nose bar 336 used with the rayon wire wound feed roll 337 differs from the pulp nose bar 313. The nose bar 336 is curved at 336*a* to essentially conform to the adjacent circumference of the rayon feed roll 337. The rayon fibers picked up from the rayon source are positively maintained in position relative to the feed roll 337 until the fibers are disposed immediately adjacent the teeth 339 of the rayon lickerin 338, which teeth will then serve to comb the fibers from the rayon source. The rayon lickerin is mounted on shaft 341, which is driven at a high speed by suitable drive means (not shown). A speed which can generally be used without seriously adversely affecting the fibers is 3,000 rpm.

The teeth of the rayon lickerin usually have a lower tooth height and pitch than the pulp lickerin. The pitch and height of the teeth used on the lickerin for the rayon may vary, good results being obtained with a tooth pitch of about one-eighth inch to about one-fourth inch and a tooth height of about one-eighth inch to about one-fourth inch. The angle of the teeth of the lickerin for the rayon may also vary, generally within the limits of about −10° to about +20°.

The individualized rayon fibers are then air-conveyed into duct 340 located between sidewall 342 and lickerin 338, which duct 340 leads into mixing zone 334. The randomly oriented wood pulp and rayon fibers in the mixing zone 334 are then directed through duct 352 onto a condenser 350 where they form a web.

The movement of the air streams flowing through the system and its action on the fiber particles to effect the doffing, blending and condensing that takes place subsequent to the individualizing will be covered in detail hereinafter.

In the process of the present invention, the length of the fibers in the condensed nonwoven web may be varied as desired by varying one or more conditions in the process. These conditions include, (*a*) the method used to open the fibers, as by adjusting the height and angle of the teeth, (*b*) the rate at which the fibers are opened and entrained, and (*c*) the method and rate of feeding the fiber source to the fiber opening and entraining step.

While the lickerins, nose bars, and fiber receiving means have been shown in a fixed position, these mechanisms may also be made adjustable relative to the frame F if this is desired.

The doffing of the fibers from the lickerins 317, 338, the air entrainment of the previously individualized fibers, the conveying of the fibers through the ducts 332, 340 into the mixing zone 334, and the conveying of the intermixed fibers through duct 352 to condenser 350 is accommplished by high velocity air that is introduced into the system by being pulled in through parallel passages 344, 346 by a suction fan (not shown).

The parallel flow paths 344, 346 lead to lickerins 317, 338, respectively to direct the high velocity air in a uniform flow pattern against the lickering teeth 316, 339, respectively, to doff the fibers clinging thereto. The air with entrained particles therein then flows through ducts 332, 340, respectively, into mixing zone 334 from where it flows through duct 352 and condenser 350. The blended randomly oriented fiber particles entrained in the air stream are deposited on the condenser in the form of a web.

The condenser 350 on which the fibers are formed into a web consists of an endless movable mesh screen conveyor 381 that is directed over four pulleys 382, 384, 386 and 388. The position of pulley 388 can be adjusted to provide suitable tension on the screen. The conveyor is driven by suitable drive means (not shown). The conveyor 381 slides over the housing 348, which contains an aperture 349, through which the air is sucked into the housing and through conduit 389 that leads to the suction fan. The speed at which the condenser is moved will determine the thickness of the web being formed. For example, the thickness of the web will be increased by decreasing the web take-away speed, and vice versa.

The screen conveyor 381 leads to another conveyor belt 390 on which the web is carried to another station for further processing, as by the bonding techniques mentioned above.

In order to help seal off duct 352 and maximize the efficiency of the suction fan being used, a pair of vertically extending plate members 366, 368 are employed to define two outer wall portions of the duct 352 between the lickerins and the condenser. The lower portion of the duct 352 between the plates 366, 368 and the condenser 350 are essentially sealed off by rollers 369 that are rotatably mounted on pivotally mounted arms 370, 372 that are connected at their upper arms to a shaft 374. The weight of the rollers and arms tends to maintain the rollers in a sealing condition to minimize the introduction of air between the rollers 369 and the plates 366, 368, and condenser 350.

Figure 4:
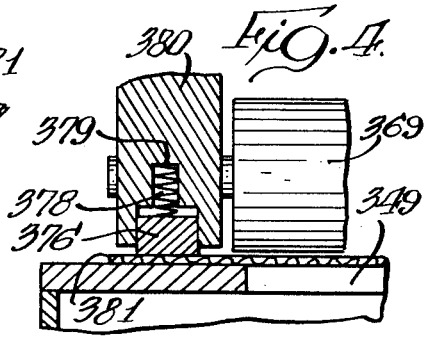
FIG. 4 is an enlarged sectional view taken along line 4—4 of FIG. 3.

Referring now to FIG. 4, there is illustrated a sealing mechanism that acts to seal the flow duct 352 along the edges of the web being formed. On each side, there is provided a floating seal 376 that is biased into contact with the web by a spring 378. The seal 376 is reciprocately mounted in a recess 379 defined in a side plate 380. This mechanism is duplicated on the opposite side to prevent introduction of air into the suction fan other than down through the flow ducts 352.

The condition and direction of the air flowing through the system has a very significant effect on the particular webs being formed. The air should have a uniform flow pattern through the system to aid in the formation of a uniform web. Also, as is taught in the Farrington application mentioned above, the air should be in a turbulent condition and have a velocity greater than the peripheral speed of the lickerin to aid in doffing the fibers from the lickerin and to prevent fiber clumping.

The ratio between the volume of air and volume of fibers passed through the system also has a significant bearing on the type of web that will be formed by the system. The air flow plays the important role that it does since it is in effect a pneumatic conveyor that deposits the fibers onto a condenser where they are formed into a web. The quantities of fibers to be conveyed determine the amounts of air to be directed against the particular lickerin used for fiberizing a given material. Thus, for example, when forming a web of 90% (by weight) of wood pulp fibers and 10% (by weight) of rayon, a substantially higher quantity of air is needed to convey the wood pulp fibers than is needed to convey the rayon fibers.

In order to control the relative quantities of air directed to the pulp and rayon lickerins while insuring that the air so introduced aids in doffing the fibers from the lickerins, the air passages 344, 346 are appropriately designed and located.

Air passage 344 is vertically disposed and the lower end is located immediately adjacent the teeth 316 of the pulp lickerin 317. The webs being formed by this system have substantial width and thus it is important that the air flow across the axial length of the lickerin be uniform, so that the thickness of the web will be constant. Also, the air acts to more effectively doff the fibers from the lickerin if it is in a generally turbulent condition. To insure that the air is uniformly distributed across the lickerin, a wedge-shaped restrictor 354, secured to plate 356 that forms a sidewall of passage 344, is provided at the lower end of passage 344. The restrictor 354 defines a throat 358 through which the air pulled through the passage 344 must pass. This throat portion 358 brings about a low pressure drop and raises the velocity of the air before it contacts the pulp lickerin teeth 316. The high velocity air directed into duct 332 from passage 344 in conjunction with the centrifugal forces imposed on the fibers due to the high speed of rotation of the lickerin 317 doffs wood pulp fibers from the lickerin teeth. The air in duct 332 entrains the fibers therein and conveys them to a mixing chamber 334. The duct 332 is directed downwardly at an approximately 45° angle and the high velocity air flowing therethrough will be directed into collision with the high velocity air flowing past the rayon lickerin, the path of which will be described below.

In a system where there is substantially less air needed to process the rayon fibers than to process the wood pulp fibers, it will be necessary to provide a substantial obstacle to the flow of air through the passage 346 to provide for the desired unbalanced air flow through the system.

In the passage 346, there is a restrictor provided in the form of an adjustable block 360, which has a substantial length and fills up a major part of passage 346. Between the plate 311 and block 360 there is defined a narrow passage 362. The block 360 severely limits the quantity of air flowing into duct 34, as compared to the air flowing through the passage 344 and into duct 332. The position of block 360 can be adjusted by mechanism 364. The width of the passageways 344, 346 can also be adjusted by the insertion of blocks of varying widths therein.

The high velocity air in duct 340 is moving faster than the peripheral speed of lickerin 338 and acts to doff the fibers from the rayon lickerin teeth 339 and entrain the fibers therein. Duct 340 is directed downwardly at a 45° angle with the result that the high velocity air flowing therethrough comes into impelling relationship with the entrained wood pulp fibers in the air stream moving downward through duct 332 into the mixing chamber 334. These air streams are moving at a very high rate of speed, with the result that when these two streams are combined, the fibers entrained therein will intermix and form a blend of randomly oriented fibers as hereinafter explained in greater detail. As the fibers are accelerated and entrained in the air streams flowing through ducts 332, 340, they possess substantial kinetic energy because of their mass and velocity, and the inertia of the fiber tends to keep them moving along a path generally in the direction of their initial trajectory. The inertia effect, in cooperation with specific air to fiber volume ratio, together with other parameters heretofore mentioned and the location of a flow controlling member to be hereafter discussed, determines the degree of blending and the specific type of web that is produced. After the streams are combined, the blended fibers then move down through the duct 352 onto the condenser 350, where a web made up of a mixture of wood pulp and rayon fibers is randomly oriented more or less uniformly throughout the web, so that the web has substantially uniform strength characteristics lengthwise and crosswise thereof.

Many different types of webs can be produced with the above described type of apparatus, depending to a large extent upon the location of the baffle 400 and the specific air to fiber volume ratios in the combined air stream. However, the major advantage of the process of the present invention, i.e., the production of a uniform web at high production speeds, is independent of the formation of any specific type of web. As is described above, with a total air to fiber volume ratio in the combined stream of between about 12,000:1 to about 275,000:1, a uniform web can consistently be produced having a C.V. of less than 10 and down to 6%, or less. With C.V. values in this range, an extremely uniform web is provided, which can be produced at high production speeds of up to 550 feet per minute, or greater, and the degree of uniformity is independent of the specific type of web that is produced by the process.

With the baffle 400 in a completely withdrawn position, as illustrated in FIG. 1, with the air to fiber volume ratios mentioned above, it has been found that the fibers entrained in the air streams flowing through ducts 332 and 340 continue to travel generally in the direction of their initial trajectory by virtue of their inertia. Since the fibers in the air streams in ducts 332 and 340 have a relatively large interstitial spacing in their respective streams at the air to fiber volume ratio mentioned above, and since the flow characteristics of the streams remain generally uniform, the voidages between the individualized fibers stay approximately the same as the streams are combined, so that a majority of fibers flowing in duct 332 tend to cross over the fibers flowing in duct 340, while a majority of the fibers flowing in duct 340 tend to cross over the fibers flowing in duct 332.

Figure 11:
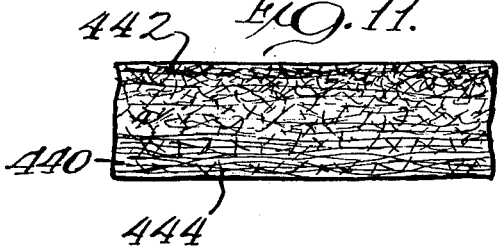
FIG. 11 is a web having a preponderance of a different type of fiber on each of the faces and a transition zone, such that the fiber type which predominates at one face diminishes in predominance from the face at which it predominates to the face at which the other fiber type predominates.

With the screen 381 of the condenser 350 moving to the right, as indicated by the directional arrow in FIG. 1, the product 440 (FIG. 11) produced by the process described in the preceding paragraph contains a predominance of rayon fibers at the lower face 444 thereof and a predominance of wood pulp fibers at the upper face 442 thereof, with the fibers decreasing in predominance in a direction away from the face at which they predominate. The transition between the opposed faces of the web is substantially uniform, so that in a specific example including a mixture of 50% (by weight) pulp fibers and 50% (by weight) rayon fibers, a web can be obtained wherein one face of the web includes 90%, by weight, of pulp fibers and 10%, by weight, of rayon fibers; while the other face of the web includes 90%, by weight, of rayon fibers and 10%, by weight, of pulp fibers. As mentioned above, the transition between the faces is substantially uniform or linear, so that the central portion of the web includes a 50:50 mixture by weight of pulp and rayon fibers. In this case, the product has randomly located fibers in both the X and Y axes.

Figure 8:
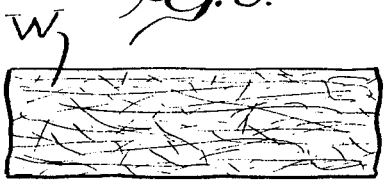
FIG. 8 illustrates a randomly oriented, fully homogeneous web.

If it is desired to produce a web comprised of a homogeneous mixture of pulp and rayon fibers, the baffle 400 is moved downwardly toward screen 381 to position the end of the baffle generally in the plane (FIG. 5) that is defined by the axes of the lickerins, so as to significantly interfere with the separate air streams flowing in ducts 332 and 340. With the baffle 400 in this position, the fibers entrained in the ducts 332 and 340 are effectively prevented from crossing over one another. Since the baffle 400 is positioned a substantial distance above the screen 381, at the air to fiber ratios mentioned above, the individual streams will be combined and the fibers therein intermixed below the lower end of the baffle 400, and a web can be produced that consists of a homogeneous blend of long and short fibers, as is shown at W in FIG. 8, which are randomly located in all directions, i.e., in the X, Y and Z axes.

Figure 5:
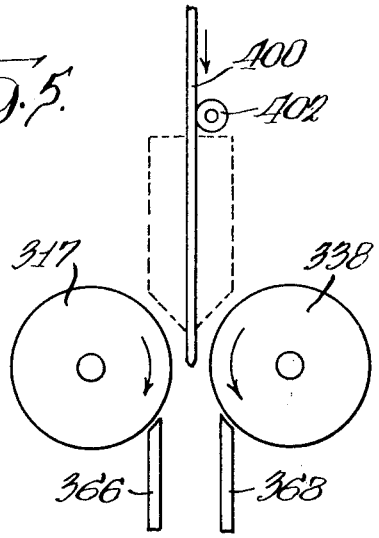
FIG. 5 is a schematic view of the apparatus showing the baffle partially extended.

By varying the baffle 400 between the position of FIG. 1 and FIG. 5, a wide variety of webs can be produced, since the specific location of the baffle will determine the amount of fibers that cross over and thereby control the cross-sectional profile of the web within the parameters heretofore described.

Figure 9:
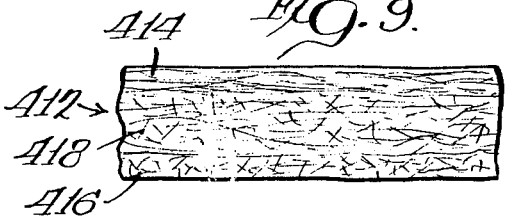
FIG. 9 shows a web having outer layers made of separate fibers and an intermediate homogeneous mixture of the two fibers.
Figure 6:
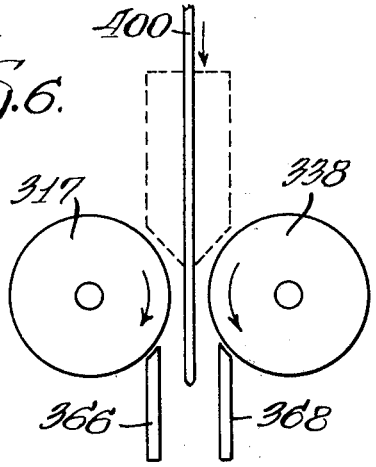
FIG. 6 is a view showing the baffle in a more fully extended position.
Figure 10:
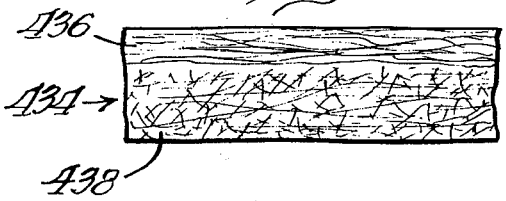
FIG. 10 is a view showing a two-layered web.
Figure 7:
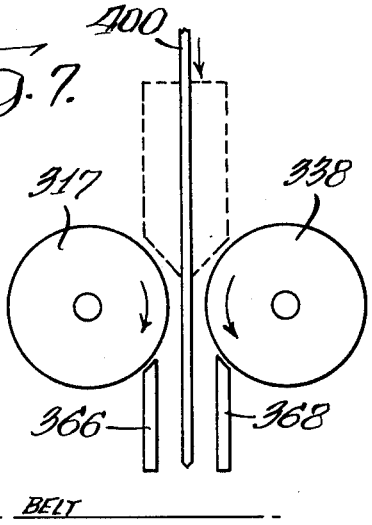
FIG. 7 is a view showing the baffle in the fully extended position wherein it is located immediately adjacent a condenser.

As the baffle 400 is moved further downwardly toward screen 281, the degree of blending of the fibers in the individual streams can be controlled so that only a portion of the individual streams are blended. This results in a web 412, such as illustrated in FIG. 9, wherein the web includes a layer of long fibers 414 at one face and a layer 416 of short fibers at the other face, with there being a central layer 418 of blended long and short fibers between layers 414 and 416. As the baffle 400 is moved downwardly, intermediate layer 418 will become thinner and thinner, and as the baffle 400 is positioned substantially immediately adjacent screen 381, as illustrated in FIG. 7, the individual streams are effectively prevented from combining with one another, so that a two layer web 434 (FIG. 10) is produced consisting essentially of a layer of long fibers 436 and short fibers 438 that are interlaced at the interface therebetween.

EXAMPLE 1

This Example illustrates the production of homogeneous random nonwoven webs comprising an 80:20 mixture of short pulp fibers and staple rayon fibers having an average rayon fiber length of approximately 0.5 inch.

The short pulp fiber source used consisted of sulphate-type pulp board marketed under the trade mark "RAY-FLUFF-Q-FIBER" which has an average length of approximately 1/16 inch; the rayon fiber source employed was rayon cards in which the average fiber length was approximately 1 9/16 inches with a denier of 1.5.

The pulp lickerin employed had a tooth angle of +3°, a tooth height of 7/16 inch, and a tooth pitch of 7/16 inch. The rayon lickerin employed had a tooth angle of +10°, a tooth height of 7/32 inch, and a tooth pitch of .20 inch. Both lickerins were approximately 9½ inches in diameter and 18 inches long and lickerin 317 was rotated at approximately 5,500 rpm, while lickerin 338 was rotated at approximately 2,800 rpm. The lickerins were spaced from one another by about 1½ inches, and from duct walls 333 and 342 by about three-fourth inch. Deflector plates 366 and 368 were spaced from one another by about 4½ inches.

The pulp board and rayon card sources were fed to the respective lickerins under the above conditions, utilizing air doffing and carrier streams for the fibers which by adjusting the volume and velocity control means for the respective streams to provide an equivalent volume ratio of air to fiber of approximately 20,000:1 for the pulp stream, and in the case of the rayon, a volume ratio of air to fiber of approximately 40,000:1, the combined air stream having a total air to total fiber value ratio of approximately 30,000:1 (equivalent to a weight ration of air to fiber of about 24:1). The velocity of each stream was maintained slightly greater than the speed of rotation of the respective lickerins. The apparatus was employed with the divider plate, having a thickness of about one-fourth inch, positioned centrally as in FIG. 5, to permit mixing of the doffed fibers from the respective streams.

The web take-away mechanism of the apparatus was adjusted to provide a take-away speed of approximately 550 ft. per minute.

The fluidizing rate for the pulp board was approximately 1,000 pounds per hour over the 18 inch width of the condensed web and approximately 150 pounds per hour for the rayon source.

The fibers from the combined carrier stream were condensed on the web take-away system, and the resulting web thereafter analyzed. The web was found to be a random nonwoven web having a weight of approximately 1400 grains per square yard with a homogeneous blend throughout a 80% by weight of pulp fibers and 20% by weight of rayon fibers. The average length of the rayon fibers in the web was approximately 0.5 inch. The web had a very uniform lay, with a C.V. of less than 8%, with no fiber clumps or weaks spots of insufficient fiber. The tensile strength characteristics of the web were found to provide a MD:CD ratio of about 1:1.

EXAMPLE 2

This example demonstrates the production of random nonwoven web consisting of 100% pulp fibers.

The procedures of Example 1 were repeated but in this case, the rayon lickerin was replaced with a further lickerin of substantially the same structure as described in Example 1 with respect to the pulp lickerin.

Separate sources of identical pulp boards were fed to each lickerin under the above described conditions in Example 1 for the pulp source, with the volume of air to fiber ratio for the combined stream being approximately 20,000:1; each air doffing and carrier steam also having an approximate 20,000:1ratio.

The resulting condensed web was removed by the web take-away mechanism at a speed of approximately 550 feet per minute over the 18 inch width of the web, and the resulting web studied to determine its characteristics.

It was found that the web had an MD:CD ratio of 1:1, a weight of approximately 1400 grams per square yard, a complete uniformity of lay with a C.V. of less than 10% and with no fiber clumps or weak spots of insufficient fiber.

EXAMPLE 3

By following the procedures of Example 1, but replacing the pulp lickerin with an equivalent rayon lickerin with respect to that described in Example 1, and using a volume ratio of air to fiber in the combined gaseous stream of approximately 40,000:1, equivalent to a weight ratio of about 31.5:1, (each individual stream having a similar ratio), rayon card fiber sources were fed to each lickerin. The total feed rate 215 pounds per hour.

The speed of the web take-away mechanism was adjusted to be approximately 400 feet per minute.

The resulting condensed web, having a weight of 250 grains per sqaure yard, was then studied and found to have an MD:CD ratio of 1:1 with a substantially complete uniform lay, and a C.V. of about 13%.

EXAMPLE 4

The procedures of Example 3 were repeated but in this case the web take-away speed was adjusted to 200 feet per minute and the feed rate was adjusted to feed 240 pounds per hour. The resulting web had substantially identical characteristics to the web described in Example 3 except for a web weight of 550 grains per square yard.

EXAMPLE 5

The procedures of Example 1 were repeated, but in this case, the divider plate 400 was fully withdrawn as illustrated in FIG. 1. In this Example, the separate sources of rayon and pulp fibers were employed, the feeding of the fiber sources to the respective lickerins was coordinated to provide a product consisting of a 50:50 mixture of pulp and rayon fibers (by weight). The combined fiber feed rate was 180 pounds per hour.

In carrying out this Example, the condensed web had a weight of approximately 550 grains per sqaure yard, and was removed from the condensation zone at approximately 150 feet per minute.

In carrying out this Example with the divider plate raised so as not to interfere with the individual gaseous streams, and by imparting to the fibers of the respective streams a high velocity (the velocity of the individual gaseous streams being such that they were greater than the peripheral speed of the lickerins), cross-over of the majority of the fibers from the individual streams, at the point where the streams join to form a common carrier stream, was observed.

In this Example, the process employed a 70,000:1 volume ratio of total gas to total fiber for the combined stream, and as well, a similar ratio for each of the individual streams (equivalent to a weight ratio of approximately 55:1).

The resulting product was studied and found to consist of a predominance of the rayon fibers at one face of the product and a predominance of pulp fibers at the opposed face of the product, with a decreasing amount of the pulp and rayon fibers from the faces at which they predominate respectively to the opposed faces. This "transition" feature was found to be substantially uniform from face-to-face. The product was also found to have C.V. of approximately 5.8%, and was uniform in appearance. The product also had an approximate 1:1 MC:CD ratio.

EXAMPLE 6

The procedures of Example 5 were repeated, but in this case, separate sources of rayon fiber were employed whereby each individual gaseous stream contained individualized and fluidized rayon fibers. The feed rate was 120 pounds per hour. The conditions of Example 5 were generally employed, except that in this case, the combined gaseous stream, formed by the individual streams containing the rayon fibers, had a total gas to fiber volume ratio of approximately 79,000:1, each individual stream having a similar ratio (equivalent to approximately 63:1 on a weight ratio basis). The product was removed from the condensation zone at a rate of approximately 100 feet per minute.

A study of the product revealed that it was substantially uniform, having a C.V. value of approximately 5.9% and a weight of approximately 469 grains per square yard. The product had an approximate MD:CD of 1:1.

By following the teachings of the above Example, the different types of rayon fibers may be employed (e.g. of different colors or of different characteristics) to provide a product having a predominance of a first type of rayon fiber at one face of the nonwoven material and at the other face a predominance of a different rayon fiber plate with a transition zone of the fibers, between the opposed faces of the product, in which the respective types diminish in a substantially uniform manner from the face at which the predominate to the opposed face.

We claim:

1. An air-laid nonwoven web having a thickness from about 1/32 inch to about 1 inch and having a pair of opposed major faces, comprised at one of said faces of a blend of a major proportion by weight of a staple length fiber having a length from about ½ inch to about 2½ inches as a first fiber type and a minor proportion by weight of short cellulose fibers having a length less than about one-fourth inch as a second fiber type interspersed therewith, and comprises at said other face of a blend of a major proportion by weight of said second fiber type and a minor proportion by weight of said first fiber type interspersed therewith, the web between said faces being comprised of a blend of fibers exhibiting a continuous uniform transition in which the proportion of said first fiber in the blend becomes progressively and continuously less with distance from said one face while the proportion of said second fiber in the blend becomes progressively and continuously less with distance from said other face, each of said fiber types being present in an amount of at least 5% at each major face.

2. An air-laid nonwoven web according to claim 1 in which said cellulose fiber is a fiber of the group consisting of wood pulp fibers and cotton linters and said staple length fiber is rayon.

3. An air-laid non-woven web according to claim 1 in which one fiber face has from about 55 to about 95% of said short cellulose fibers.

4. An air-laid nonwoven web according to claim 1 wherein said web has an MD:CD ratio of between about 1:3 to about 5:1.

* * * * *